United States Patent [19]

Folger

[11] 4,083,590

[45] Apr. 11, 1978

[54] NARROW STILE PANIC EXIT ACTUATOR

[75] Inventor: Roger J. Folger, Whittier, Calif.

[73] Assignee: Adams Rite Manufacturing Co., Glendale, Calif.

[21] Appl. No.: 764,726

[22] Filed: Feb. 2, 1977

[51] Int. Cl.[2] ..... E05C 3/16

[52] U.S. Cl. ..... 292/92; 70/92; 292/21; 292/168

[58] Field of Search ..... 292/92, 93, 35, 166, 292/168, 221, 227, 21, 169.13, 169.14, 169.17; 70/92, 465

[56] References Cited

U.S. PATENT DOCUMENTS

| | | | |
|---|---|---|---|
| 2,328,936 | 9/1943 | White | 292/93 |
| 3,024,053 | 3/1962 | Cox et al. | 292/92 X |
| 3,073,143 | 1/1963 | Eads | 292/169.13 |
| 3,582,122 | 6/1971 | Foster et al. | 292/92 X |
| 3,614,145 | 10/1971 | Zawadzki | 292/92 |
| 3,663,047 | 5/1972 | Zawadzki | 292/92 |
| 3,730,574 | 5/1973 | Zawadzki | 292/92 |
| 3,767,238 | 10/1973 | Zawadzki | 292/92 X |
| 3,854,763 | 12/1974 | Zawadzki et al. | 292/92 X |
| 3,869,159 | 3/1975 | Eads | 292/92 |
| 4,005,886 | 2/1977 | Lirette | 292/92 X |

FOREIGN PATENT DOCUMENTS

| | | | |
|---|---|---|---|
| 822,406 | 10/1959 | United Kingdom | 292/336.3 |

*Primary Examiner*—Roy D. Frazier
*Assistant Examiner*—Rodney H. Bonck
*Attorney, Agent, or Firm*—Whann & McManigal

[57] ABSTRACT

A panic exit actuator and locking mechanism adapted particularly for mounting on a narrow stile door frame with the actuator spanning substantially the full door width and extending between the inner and outer narrow stile frame members, and wherein the lock mechanism is mounted in the outer narrow stile frame member and has a latch bolt supported for movement between latched and unlatched positions, the latch bolt being releasably retained in the latched position by deadlock means and being movable to an unlatched position in response to pressure applied in a door opening direction to a push bar that is movably supported on one or more linkage assemblies having an operating connection with actuating means operable to initially release the deadlock and thereafter move the latch bolt to the unlatched position. The latch bolt in latched position is arranged to engage a strike formed with a camming surface such that, with the deadlock released, the application of opening pressure against the door will cause the camming surface to effect movement of the latch bolt to its unlatched position.

12 Claims, 7 Drawing Figures

FIG. 1.
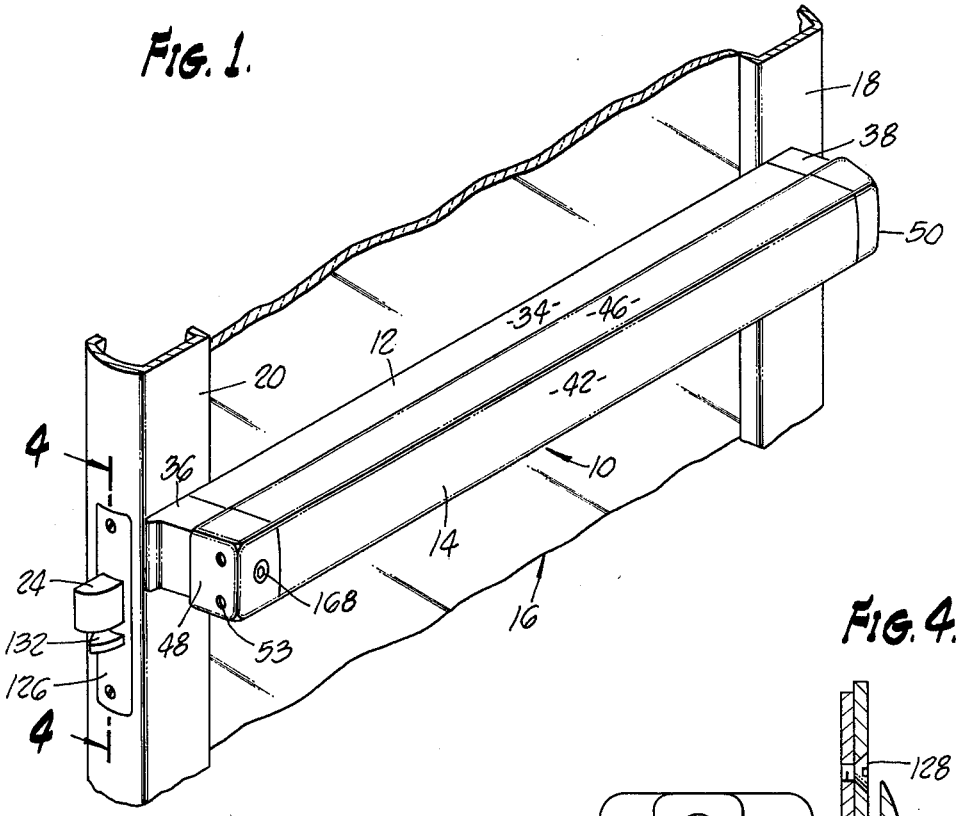
FIG. 4.
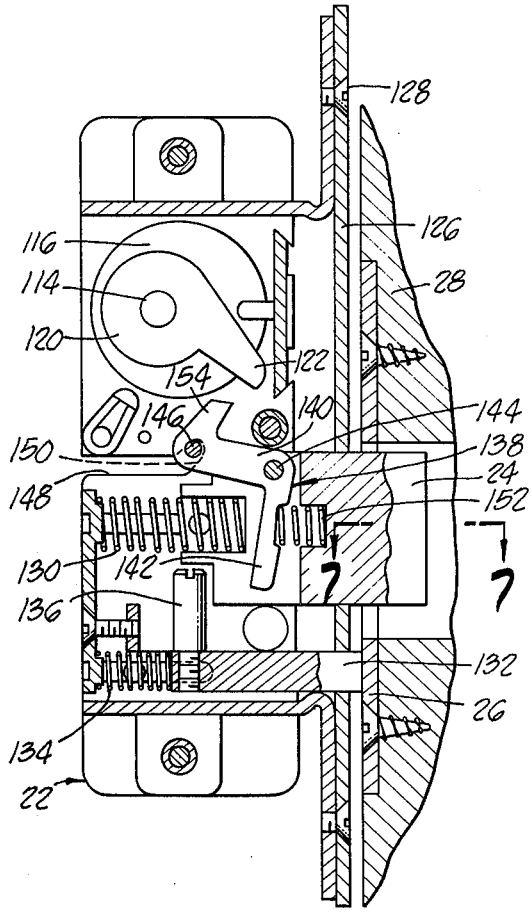
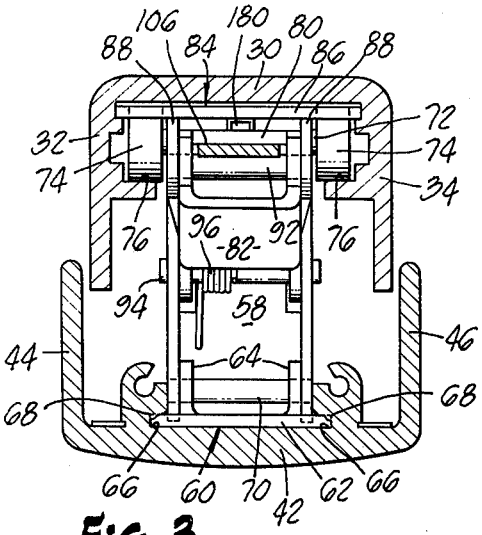
FIG. 3.

NARROW STILE PANIC EXIT ACTUATOR

BACKGROUND OF THE INVENTION

The present invention relates generally to the field of safety exit devices for doors and the like.

Heretofore, such devices have been generally known from a number of patents which are exemplified by Deutscher et al. U.S. Pat. No. 3,432,631, dated Mar. 11, 1969; Zawadzky U.S. Pat. No. 3,614,145 dated Oct. 19, 1971, Zawadzky U.S. Pat. No. 3,363,047, dated May 16, 1972 and Williams U.S. Pat. No. 3,877,262.

The structures disclosed in these patents all relate to panic exit devices which utilize a push bar rather than the previously shown devices having a pivotally supported panic bar. Aside from this common structural characteristic, however, it is significant to note that the device of each of these patents are fabricated as a complete unit for attachment to the door frame, and each device includes the latch bolt as a component part of the unit which is to be attached to the exit door frame. Thus, these prior arrangements necessitate the installation of an additional keeper or strike separate and apart from that which may be normally required for a conventional lock mechanism which may be installed in the door frame structure.

In the present invention, the panic exit device utilizes a push bar actuator unit of simplified and unique construction, which can be attached to the frame structure on the inside of a door, particularly in the case of frames of the so-called extruded narrow stile type, and which can be connected to and utilized with a conventional already installed or to be installed lock mechanism; and in addition to being operable by the push bar of the panic device, they are also operable independently by an operatively associated conventional key-controlled or manually operable means mounted on the door frame, such means being accessible from the outside of the door.

SUMMARY OF THE INVENTION

The present invention is more specifically concerned with improvements in panic exit devices which are susceptible of mounting as a unit on the inside of a door for the emergency actuation of a conventional lock mechanism of the deadlocking type mounted in an adjacent portion of the door frame.

It is one object of the herein described invention to provide a simplified and improved emergency exit device for a door, in the form of an elongated unit assembly which can be mounted on the inside of the door, which contains a housing with an exposed push bar of a length to transversely span the entire door width, and in which the push bar is operatively connected with a latch bolt of a conventional lock assembly mounted in a portion of a door frame.

A further object is to provide an emergency exit device of the push bar type for the actuation of an independently mounted locking mechanism in a door frame, in which depression of the push bar initially releases a deadlock on the latch bolt of the locking mechanism prior to moving the latch bolt to an unlatched position.

A further object is to provide a device according to the foregoing object in which the latch bolt will be cammed out of latched engagement with an operatively associated strike, upon the application of a door opening pressure against the door, subsequent to release of the deadlock.

Another object is to provide in connection with an emergency exit device of the push bar type, unique means for latchingly retaining the push bar in a depressed position to maintain the door latch bolt in an unlatched position.

Still another object is to provide an emergency exit device which has an elongate substantially rectangular housing for mounting on the inside of a door, which will transversely span the distance between the inner and outer door frames, and which includes an exposed push bar which is substantially coextensive with and outwardly overlaps the periphery of the housing. With this arrangement, it is virtually impossible, during panic and emergency conditions, to inadvertantly apply a door opening force or manual pressure against any part of the device except the push bar.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrated purposed only:

FIG. 1 is a fragmentary perspective view showing a panic exit actuator according to the present invention as being mounted on the inside of a door and spanning transversely the space between the inner narrow stile and the outer narrow stile of the door frame;

FIG. 3 is an enlarged transverse sectional view taken substantially on line 3—3 of FIG. 2;

FIG. 4 is a sectional view of an independently mounted locking mechanism of a type with which the panic actuator of the present invention may be utilized;

DESCRIPTION OF A PREFERRED EMBODIMENT

Figure 2:
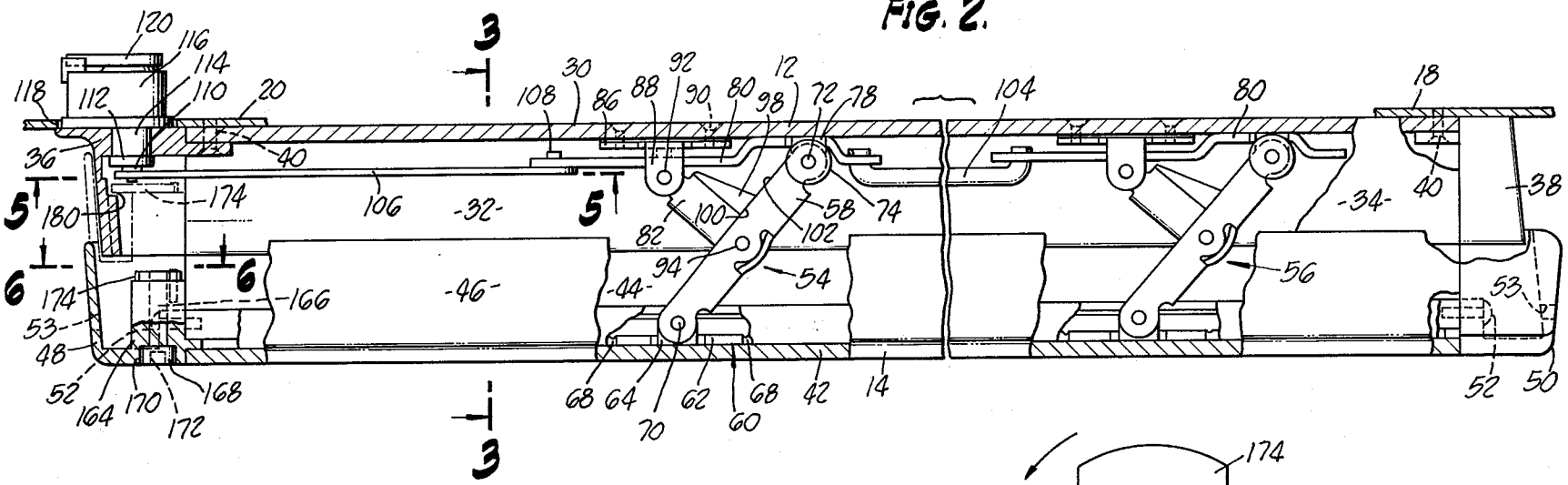
FIG. 2 is an enlarged longitudinal horizontal section of the actuator illustrating the interconnecting means between the push bar and cam for actuating an associated lock mechanism.

For illustrative purposes, there is disclosed in FIG. 1 a panic exit actuator according to the present invention, the actuator being generally indicated by the numeral 10 and comprising an elongate housing 12 and coextensive exposed push bar 14. The housing 12 is proportioned and designed to horizontally span the inside of a door or other hinged closure 16, when the ends of the housing 12 are respectively mounted on inner and outer stiles 18 and 20 of the extruded narrow stile type.

The panic actuator is operatively coupled with a locking mechanism, as generally indicated at 22 (FIG. 4), which is mounted in the stile 20 and includes a projecting reciprocable latch bolt 24 adapted in the closed position of the door to be operatively associated with a strike 26 mounted in a mating door frame 28.

More specifically, as shown in FIG. 3, the housing 12 comprises an elongated generally U-shaped extrusion member fabricated to provide a backwall 30 and integrally formed parallel side walls 32 and 34. The opposite ends of this extrusion are respectively closed by separate end caps 36 and 38 which are secured to the ends of the extrusion as by suitable screws 40, these screws also serving to secure the respective ends of the housing 12 to the door stiles 18 and 20.

The push bar 14 is similarly constructed with an elongate U-shaped extrusion which comprises a front wall 42 and parallel side walls 44 and 46. The ends of this extrusion are similarly closed by end caps 48 and 50, the respective caps being attached to the associated ends as by suitable screws 52, having head portions accessible through openings 53.

The housing and push bar have peripheral wall portions in overlapped relation, the walls of the push bar being outwardly overlapped with respect to the walls of the housing. Normally, the push bar occupies a position outwardly spaced from the housing, as shown in full lines in FIG. 2, but is supported for movement towards the housing to a position as shown in phantom lines. For this purpose, the push bar is supported by means of a pair of identical toggle-like linkage assemblies 54 and 56. Since these linkage assemblies are identical, only one will be described in detail.

Each of the linkage assemblies 54, 56, are fabricated to provide linkage elements of generally transverse channel configuration. Each assembly includes a first rigid link 58 which is connected at its outer end to the push bar 14 by means of a bracket 60 with a base plate 62 and upturned ears 64. The base plate has opposite edges which are seated in longitudinally extending grooves 66 formed in the push bar extrusion. The bracket is retained in a fixed position on the push bar by deflecting portions of the groove edges as by staking, as indicated at 68 on each side of the base plate 62. A pivot pin 70 swingably connects this end of the link 58 to the ears 64.

The opposite end of the link 58 pivots on a shaft 72 which mounts a pair of rollers 74 respectively at its ends, these rollers being movable longitudinally of the extrusion of the housing 12 within guide grooves 76 respectively formed in the side walls 32 and 34, as best shown in FIG. 3. As shown in FIG. 2 the shaft 72 is supported by a pair of side ears 78 of an actuator element 80 of a strap-like material, and which is supported for reciprocable endwise sliding movement in a longitudinal direction along the housing back wall 30.

A second rigid link 82 connects at one end with a connecting bracket 84 which is fabricated with a base plate 86 and upturned side ears 88. The base plate is fixedly secured to the back wall 30 of the housing 12 as by screws 90. The ears 88 provide a support for a pivot pin 92 which swingably supports the adjacent end of the second rigid link 82. The opposite end of link 82 is pivotally connected to link 58 by a pivot pin 94 which is equally distant from the axis of pivot pin 92, the axis of pivot pin 70 and the axis of shaft 72.

The links 58 and 82 are urged towards an extended position by means of a coiled spring 96 which surrounds the pivot pin 94 and has one end engaged with a portion of link 58, and another end engaged with a portion of link 82, as shown in FIG. 3. Outward movement of the push bar by the spring 96 is terminated by an angular wing portion 98 integrally formed on link 82, this wing portion having an abutment edge 100 which is adapted to engage an adjacent edge 102 of link 58. When the push bar 14 is depressed, the linkage assembly collapses, and the action of the links 58 and 82 is such that the roller 74 will be moved towards the right, as viewed in FIG. 2, and thus longitudinally move the connected actuator element 80 towards the right. In order to unitize the movement of the actuator elements 80 connected with the respective linkage assemblies, the actuator elements 80 are interconnected by a connecting rod 104. It is important to note that, in the linkage assembly as described above, the movement of the push bar 14 is not perpendicularly rectilinear with respect to the associated housing, but will instead follow a slightly curved path during its movement from the full-line position as shown in FIG. 2 to the depressed position as indicated in phantom lines. This curved path of movement is due to the fact that the pivot 92 provides a rotational axis which is not only further from the back plate 30 than the axis of shaft 72, but is also laterally displaced to the left of an imaginary perpendicular line extending from the back wall 30 through the axis of pivot pin 70.

Figure 5:
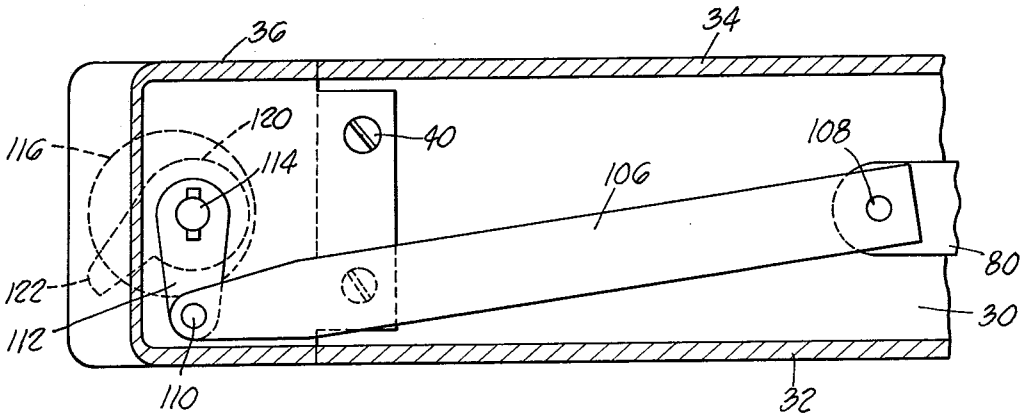
FIG. 5 is an enlarged vertical sectional view, taken substantially on line 5—5 of FIG. 2, and showing the details of connecting elements for motivating the cam for actuation of the lock mechanism.

Reciprocal movements of the actuator element 80 are utilized for actuating the locking mechanism 22. To this end, an elongated connecting link 106 is connected at one end to the adjacent end of the actuator element 80 as by a pivot connection 108, and at its opposite end with a crank pin 110 at the outermost end of a crank arm 112, this crank arm being affixed to and rotatable with a shaft 114. The shaft 114 is rotatably mounted in a cylindrical bearing housing 116 which is appropriately supported on the housing end cap 36 and adapted to extend into the interior of the stile frame 20 through an appropriate opening 118, when the panic actuator 10 is mounted on the door frame. The other end of the shaft 114 is connected with a cam member 120 formed with a radial arm 122, as shown in FIGS. 4 and 5, for actuating the locking mechanism 22 which is mounted within the stile 20.

The locking mechanism 22 may vary as to construction, but in the present application has been illustrated as comprising a well known conventional lock mechanism such as that disclosed in the Eads U.S. Pat. No. 3,073,143, issued Jan. 15, 1963, and which is incorporated herein by reference. As shown in FIG. 4, the lock instrumentalities are operatively embodied in an appropriate frame structure which is mounted within the stile 20 for actuation in response to the rotation of the cam arm 122 in one direction away from a rest position as shown in FIG. 4.

As shown, the latch bolt is arranged to extend through an appropriate opening in a face plate 126 which is secured in its mounted position on the outer face of the stile 20 as by screws 128.

The latch bolt 24 is supported for reciprocable movement between an unlatched retracted position and a latched extended position, the latch bolt being normally urged towards the latched position by means of a compression spring 130. Mounted directly below the latch bolt 24 is a reciprocably mounted deadlock actuator 132 which is also movable between retracted and extended positions in a manner similar to the bolt 24. The actuator 132 is positioned so as to engage against the strike 26 when the door is closed. The deadlock actuator is normally urged by a compression spring 134 to its extended position. As shown, the deadlock actuator is provided with an upstanding stud 136 which is operably associated with the dead-locking mechanism.

Mounted within a slotted portion of the latch bolt 24 is a locking member 138 having angularly positioned arms 140 and 142, the locking member being pivoted at the juncture of the arms on a pivot pin 144 for rocking movement. The arm 142 is in the path of movement of the stud 136, while the arm 140 extends generally longitudinally of the latch bolt 24 and is provided at its outermost end with a laterally extending pin 146 positioned with its opposite ends in adjacent horizontal guide slot 148 formed in adjacent side plates of the lock frame structure. The innermost end of each guide slot terminates in an offset notch 150 into which the pin 146 is adapted to move when the bolt 24 is in extended latched position and the locking member 138 has been rotated in a clockwise direction under the action of a compression spring 152 against the arm 142. In this position, the bolt 24 is deadlocked against movement to its retracted unlatched position. The outermost end of the arm 140 is deformed to provide an upwardly extending hook 154 which extends into the path of movement of the cam arm 122.

From a consideration of the lock mechanism as described above, it will be apparent that, when the door is in an opened position, the latch bolt 24 will be urged to its latched position by the spring 130, and at the same time, the deadlock actuator 132 under the action of spring 134 will also move to its extended position, whereupon the stud 136 will engage the arm 142 and swing the deadlocking member 138 in a counterclockwise direction so as to release the pin 146 from its deadlocking position in the notch 150. However, upon door enclosure, the deadlock actuator 132 will be forced to its retracted position and release the deadlocking member 138 for rotation under the action of spring 152 in a clockwise direction to carry the pin 146 into a deadlocking position of the bolt in the notch 150.

In the event of an emergency, the deadlocked latch bolt 24 may be moved to a non-latching position by the application of pressure on the push bar 14 in a manner to act through the linkage assemblies 54, 56, the actuator elements 80, the link and crank connection 106, 112 and the cam arm 122 to release the latch bolt 24.

In releasing the latch bolt 24, it will be apparent that the cam arm 122 will sequentially first engage the hook 154 and operate to release the deadlocking means, and thereafter upon continued rotation of the cam member 120 operate to move the latch bolt to its non-latching position.

Figure 7:
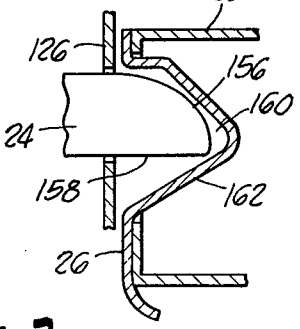
FIG. 7 is an enlarged fragmentary horizontal sectional view, taken substantially on line 7—7 of FIG. 4, and illustrating the operative relationship between the bolt and camming surface on the strike.

In conventional door locking mechanisms, such as that illustrated in FIG. 4, the latch bolt is usually formed at its outermost end with a configuration such as shown in FIG. 7. In this respect, the end of the latch bolt is usually beveled or curved as indicated at 156 in order to facilitate retraction of the bolt when it engages the strike during movement of the door to a closed position. The rear face of this end of the bolt is usually planar as indicated at 158, and, in the closed position of the door, this planar surface usually extends along a parallel surface formed in a recess, such as indicated at 160, of the strike structure.

The use of a conventional latch bolt and strike recess structure may create undesirable frictional forces, when the lock mechanism is utilized with a panic actuator which sequentially releases a deadlock prior to retracting the latch bolt. For example, after the deadlock is released, further pressure could be applied to the door structure under panic conditions which would push the planar surface 158 of the latch bolt against an associated planar surface of the strike recess structure, and in this manner create undesirable frictional forces which could hinder the subsequent movement of the latch bolt by continued pressure on the push bar after the deadlock has been released.

In the present invention, this problem has been substantially alleviated by providing a camming surface which will automatically tend to move the latch bolt towards its unlatched position in response to the application of door opening pressure. As illustrated in FIG. 7, the recess 160 is constructed with an angularly inclined wall 162 adjacent the planar surface 158 of the latch bolt. The wall 162 extends substantially at an angle of 30° with respect to the planar surface 158 or to the longitudinal axis of the latch bolt 24, and thus provides a camming surface which is engageable by the tip end of the latch bolt during the application of door opening pressure. As a result, the camming effect of the wall 162 will tend to automatically move the latch bolt 24 towards unlatched position in response to the application of door opening pressure, after the dead-lock has been released. The operation of the panic actuator is thus greatly facilitated.

Figure 6:
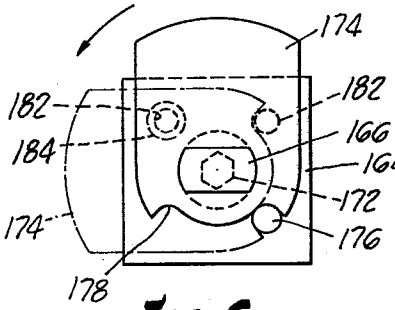
FIG. 6 is an enlarged fragmentary vertical sectional view, taken as substantially on line 6—6 of FIG. 2, and illustrating the operative positions of the dogging arm for releasably latching the push bar in a depressed position.

It will be appreciated that there may be times when it will be found desirable to retain the latch bolt in its unlatched position in order that the door may be freely opened without the necessity of having to operate the panic actuator. In the present invention, this is accomplished by the provision of unique latching means which may be operable by means of a special key or tool. For such purpose, as shown in FIGS. 2 and 6, the end cap 48 of the push bar 14 is provided with an inwardly projecting boss 164 which rotatably supports a shaft member 166. At its outermost end, the shaft member is formed with a head portion 168 which is accessible through an opening 170 in the front wall 42 of the push bar. The head portion is provided with a recess 172 of multisided configuration for the reception of an appropriately turning key (not shown). The innermost end of the shaft member is connected with a dogging arm or cam 174. The cam 174 is limited for rotative movements between 90° angular positions, as shown in full lines and phantom lines in FIG. 6, by means of a stop pin 176 positioned within an arcuate edge cutout 178. With the push bar 14 depressed, the cam 174 may be moved to its phantom line position wherein the end of the cam 174 is adapted to underly a projecting shoulder 180 formed on an adjacent wall of the end cap 36 of the housing. In this position, the push bar 14 will be retained in a depressed position, and the lock bolt 24 retained in its unlatched position so that the door may be freely opened and closed. In order to release the cam 174, it is only necessary to rotate it to its full-line position so as to clear the shoulder 180. For releasably retaining the cam 174 in its respective positions of operation, the underface of the cam 174 is provided with a pair of dimples or depressions 182 in angular 90° relationship. These depressions are adapted to selectively register with a spring-pressed ball 184 supported for movement in the adjacent portion of the boss 164.

From the foregoing description and drawings, it will be clearly evident that the delineated objects and features of the invention will be accomplished.

Various modifications may suggest themselves to those skilled in the art without departing from the spirit of my invention, and, hence I do not wish to be restricted to the specific forms shown and uses mentioned, except to the extent indicated in the appended claims.

I claim:

1. A panic exit actuator mechanism for mounting on a narrow stile door frame in operative relation with a lock mechanism mounted in an associated portion of the narrow stile door frame, said lock mechanism including a latch bolt supported for movement between latched and unlatched positions, comprising:

a. housing means for mounting on a face of the door on said door frame;

b. bearing means projecting from the back side of said housing adapted in the mounted position of the housing to have an outer end thereof disposed in the associated stile frame adjacent said latch bolt;

c. an actuator element supported within the housing for movements in opposite directions;

d. means for actuating said latch bolt in response to movements of said actuator element, comprising:
   a shaft rotatably supported in said bearing means,
   a cam member at one end of the shaft for operative association with the latch bolt,
   a crank member at the other end of the shaft within the housing, and
   an elongate link member having one end pivotally connected to said actuator element and its other end pivotally connected to the crank member;

e. a push bar extending along the front side of said housing;

f. means supporting said push bar for guided non-rectilinear movements towards and away from said actuating element, and further constituting an operative connection between the push bar and actuator element for moving the actuator element in a direction to effect rotation of the cam member in a direction to move the associated latch bolt to an unlatched position; and g. means for resiliently urging the push bar in a direction away from said actuator element.

2. A panic exit actuator according to claim 1, in which said push bar supporting and guide means includes at least one articulate linkage assembly comprising:

a first link member pivotally connected at one end to said actuator means, and pivotally connected at an opposite end to said push bar;

a second link member pivotally connected at one end to said housing means, and pivotally connected at an opposite end to said first link.

3. The combination according to claim 2, in which said linkage assembly includes stop means for limiting the extent of movement of the push bar in a direction away from said actuator means.

4. The combination according to claim 3, in which said stop means comprises an abutment surface on one of said link members engageable by an abutment surface on the other of said link members.

5. The combination according to claim 2, in which the opposite end of said second link is pivotally connected to said first link at a point between the ends of said first link.

6. The combination according to claim 5, in which the length between the pivotal axis at the point of connection of the connected end of the second link member and the pivotal axis of the other end of said second link member, and the length between the pivotal axis at said point of connection and each of the pivotal axes respectively at the ends of said first link member, are substantially equal.

7. The combination according to claim 2, in which the length of said first link member between the pivotal axes of its ends in at least twice the length of said second link member between the pivotal axes of its ends.

8. The combination according to claim 2, in which the axis of the pivotally connected one end of the first link member to said actuator means is spaced a greater distance from the push bar than the axis of the pivotally connected one end of the second link member to the housing means.

9. The combination according to claim 2, in which the actuator means comprises a plurality of actuator elements mounted in spaced apart relation on said housing means for rectilinear movements in opposite directions; in which a plurality of said link assemblies are respectively connected with said actuator elements and said push bar; and in which adjacent actuator elements are interconnected by a connector link for unitary movement.

10. A panic exit actuator according to claim 1,
in which said housing and push bar have substantially co-extensive transverse elongate rectangular configuration.

11. A panic exit actuator according to claim 10, in which the push bar and housing have confronting peripheral walls in overlapping relation.

12. A panic exit actuator according to claim 11 in which the peripheral wall of the push bar outwardly overlaps the peripheral wall of the housing.

* * * * *